US006095844A

United States Patent [19]

Kasai

[11] Patent Number: 6,095,844

[45] Date of Patent: Aug. 1, 2000

[54] ELECTRICAL CONNECTION BOX WITH RESTRAINED OUTER DIAMETER

[75] Inventor: Koji Kasai, Yokkaichi, Japan

[73] Assignee: Sumitomo Wiring Systems, Ltd., Japan

[21] Appl. No.: 09/195,805

[22] Filed: Nov. 19, 1998

[30] Foreign Application Priority Data

Nov. 19, 1997 [JP] Japan ..... 9-318175
Jan. 14, 1998 [JP] Japan ..... 10-005584

[51] Int. Cl.[7] ..... H01R 13/627

[52] U.S. Cl. ..... 439/352; 439/350

[58] Field of Search ..... 439/345, 346, 439/347, 350, 352, 353, 354, 357, 358, 270, 259, 260, 261

[56] References Cited

U.S. PATENT DOCUMENTS

| | | | |
|---|---|---|---|
| 4,332,432 | 6/1982 | Colleran | 339/75 M |
| 4,486,062 | 12/1984 | Kasugai | 339/91 R |
| 4,533,194 | 8/1985 | Boichut et al. | 339/91 R |
| 5,403,193 | 4/1995 | Ito et al. | 439/39 |
| 5,490,794 | 2/1996 | Kobayashi et al. | 439/212 |
| 5,549,490 | 8/1996 | Buetas | 439/724 |
| 5,605,471 | 2/1997 | Plyler | 439/489 |
| 5,718,596 | 2/1998 | Inaba et al. | 439/352 |

*Primary Examiner*—Paula Bradley
*Assistant Examiner*—Alexander Gilman
*Attorney, Agent, or Firm*—Bierman, Muserlian and Lucas

[57] ABSTRACT

An electrical connection box which includes a main housing, a hollow connector holder, a retainer, and a connector unit. The connector holder projects from an outer face of the main housing and the retainer surrounds a portion of the outer surface of the connector holder. The connector unit is releasably engaged in the connector holder. A busbar is introduced into the main housing through an insertion groove and there is a slit, contiguous with the groove, on the perimeter wall of the connector holder. A contact terminal projects from the busbar into the connector holder. A connector unit is releasably attached to the outer face of the connector holder and a connection terminal is in the connector unit adapted to mate with a contact terminal. By virtue of the retainer surrounding the end of the outer surface of the connector holder, the predetermined outer shape of the perimeter wall is maintained during insertion and affixing of the connector unit.

7 Claims, 7 Drawing Sheets

ELECTRICAL CONNECTION BOX WITH RESTRAINED OUTER DIAMETER

This Application claims the benefit of the priority of Japanese Applications 9-318175, filed Nov. 19, 1997, and 10-5584, filed Jan. 14, 1998.

The present Invention is directed to an electrical connection box intended for mounting in the engine compartment of an automobile and which is used to supply power to various pieces of electrically powered equipment.

BACKGROUND OF THE INVENTION

A typical prior art electrical connection box is shown in FIGS. 11 and 12 hereof. As can be seen therefrom, insertion groove 42 is formed on the outer surface of main housing 41. Busbar 43 is inserted into main housing 41 through insertion groove 42. Cylindrical connector holder 44 projects from an outer face of main housing 41. Slits 45 are formed on either side wall of connector holder 44 so as to be contiguous with insertion groove 42. Connection terminal 46 projects from busbar 43 into connector holder 44.

Connector 47 is removably attached to connector holder 44 and is adapted to mate with connection terminal 48, which is disposed in the connector holder. Engagement claw 49 projects from the inner surface of the perimeter wall of connector holder 44 and engagement projection 50 projects from the outer surface of connector 47 so that it can be engaged by the engagement claw. This engagement holds and provides support for connector 47 and connector holder 44 in their affixed position.

Busbar 43 is connected to a power supply (not shown) via wire harness 51 and the connection between contact terminal 46 and connection terminal 48. Thereafter, the current is distributed to the various electrical elements.

In the foregoing electrical connection box, slit 45 is formed in the perimeter wall of connector holder 44 and located so as to be contiguous with insertion groove 42 of main housing 41. The busbar is inserted into the housing via this insertion groove and through the slit. Thus, when connector unit 47 is inserted into connector holder 44, as shown in FIG. 12, the perimeter wall of connector holder 44 causes slit 45 to expand. As a result, connector 47 can tilt and even cause disengagement of engagement projection 50 from claw 49. This could permit connector 47 to fall out of connector holder 44. It is an object of the present Invention to overcome the foregoing problem and to thereby provide an electrical connection box which prevents the connector unit from expanding the slit and from tilting or falling out of the connector holder.

BRIEF DESCRIPTION OF THE INVENTION

The electrical connection box of the present Invention includes a main housing and a hollow connector holder projecting from an outer face thereof. A retainer is provided on an outer surface of the connector holder and is complementary thereto and a connector unit is releasably connected thereto.

Within the main housing is a busbar, for forming the desired electrical connections, which has been introduced through an insertion groove on the exterior of the main housing. The connector holder is provided with a slit which is contiguous with the insertion groove; a contact terminal projects from the busbar into the connector holder.

A connector unit is releasably attached to an outer face of the connector holder and a connection terminal, in the connector unit, is adapted to mate with the contact terminal. The retainer surrounds the outer surface of the connector holder, thereby maintaining the predetermined outer conformation thereof, preventing expansion of the slit and the resultant tilting or falling out of the connector unit.

The shape of the retainer is not critical except that it must conform to the outer surface of the connector holder. In a preferred form of the Invention, the retainer is four-sided; a circular cross section is also particularly useful.

The connector holder and retainer are secured to each other by means of an engagement projection on one and an engagement cavity on the other. The engagement projection and engagement cavity are so located that, when the retainer is properly on the connector holder, the aforementioned projection and cavity are engaged.

In a particularly preferred form of the Invention, a stabilizing projection is located on the external side surface of the connector unit. A contact section is on the interior wall of the retainer and located in the slit. In this manner, the stabilizing projection contacts the contact section when the connector unit is attached to the connector holder. It is to be preferred that the inner surface of the contact section be coplanar with the inner wall of the connector holder. For simplicity of manufacture, the contact section is desirably integral with the retainer and can slide along the slit as the retainer is placed on the connector holder.

BRIEF DESCRIPTION OF THE DRAWINGS

In the accompanying drawings, constituting a part hereof, and in which like reference characters indicate like parts.

DETAILED DESCRIPTION OF THE INVENTION

Figure 1:
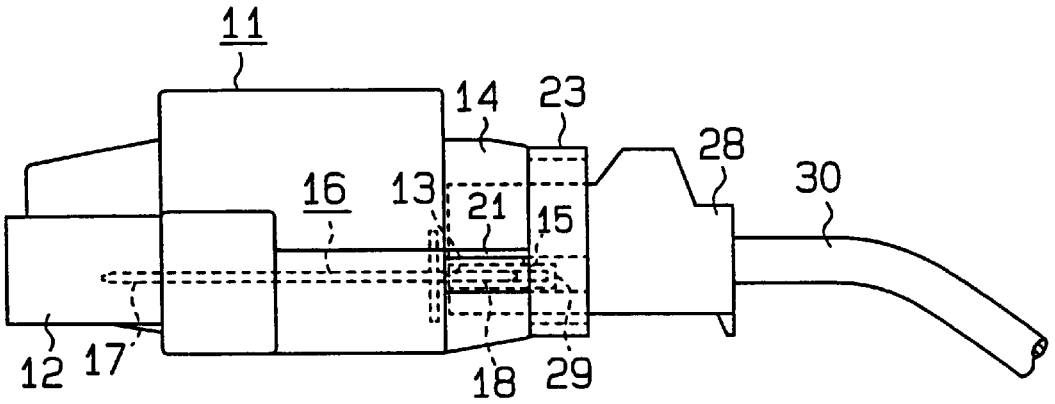
FIG. 1 is a side view of an electrical connection box in accordance with the present Invention.
Figure 2:
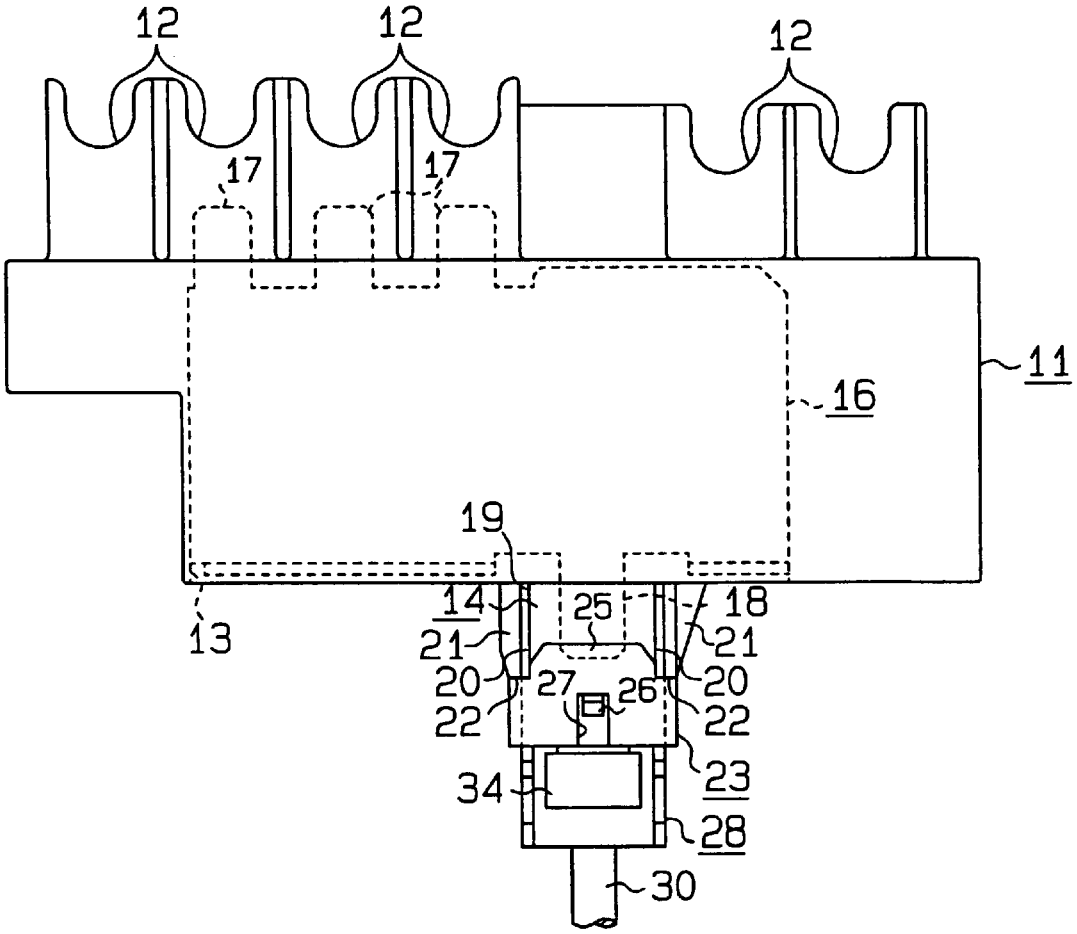
FIG. 2 is a plan view of the electrical connection box of FIG. 1.
Figure 3:
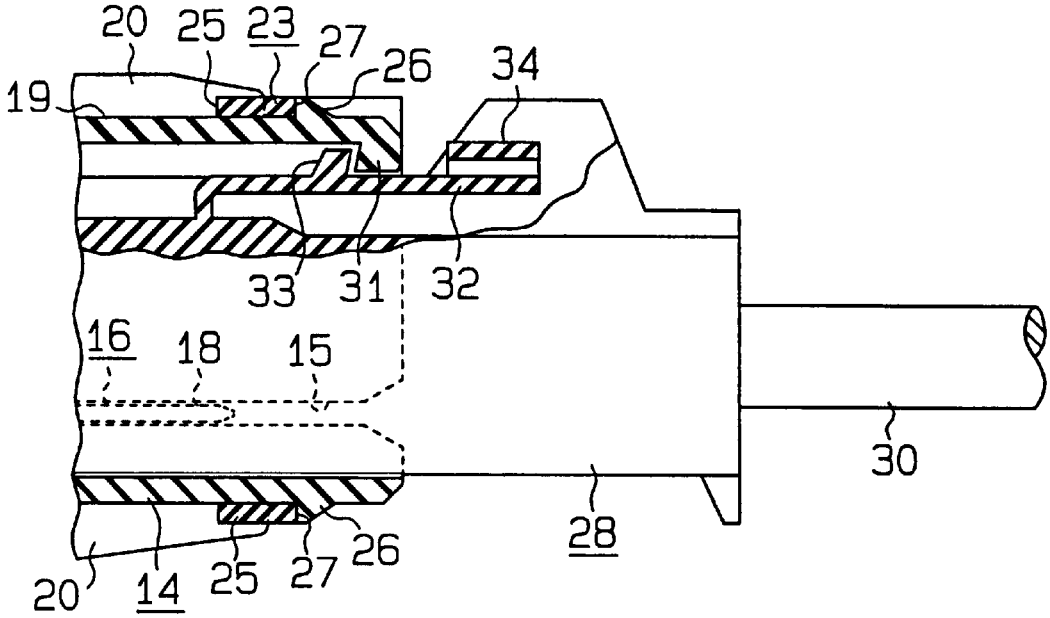
FIG. 3 is an enlarged view, partly in section, showing the principal elements of the present Invention.
Figure 4:
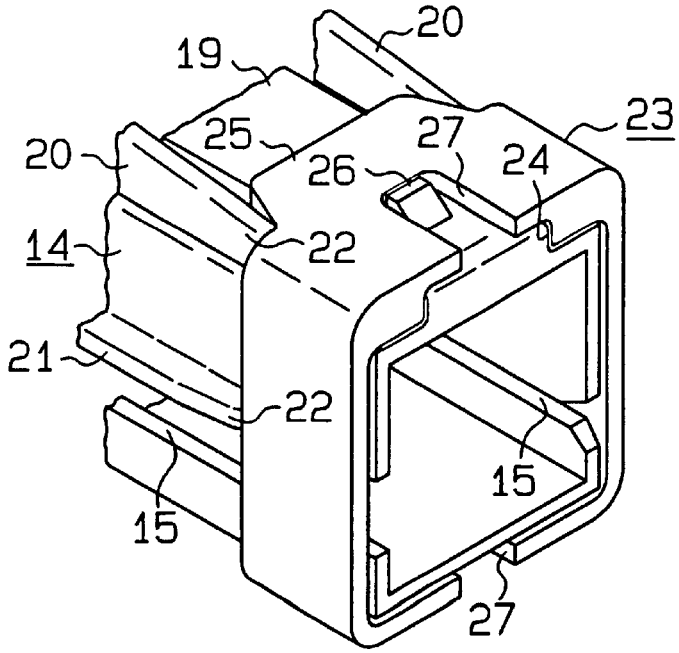
FIG. 4 is a perspective view showing the retainer and connector holder affixed to each other.
Figure 5:
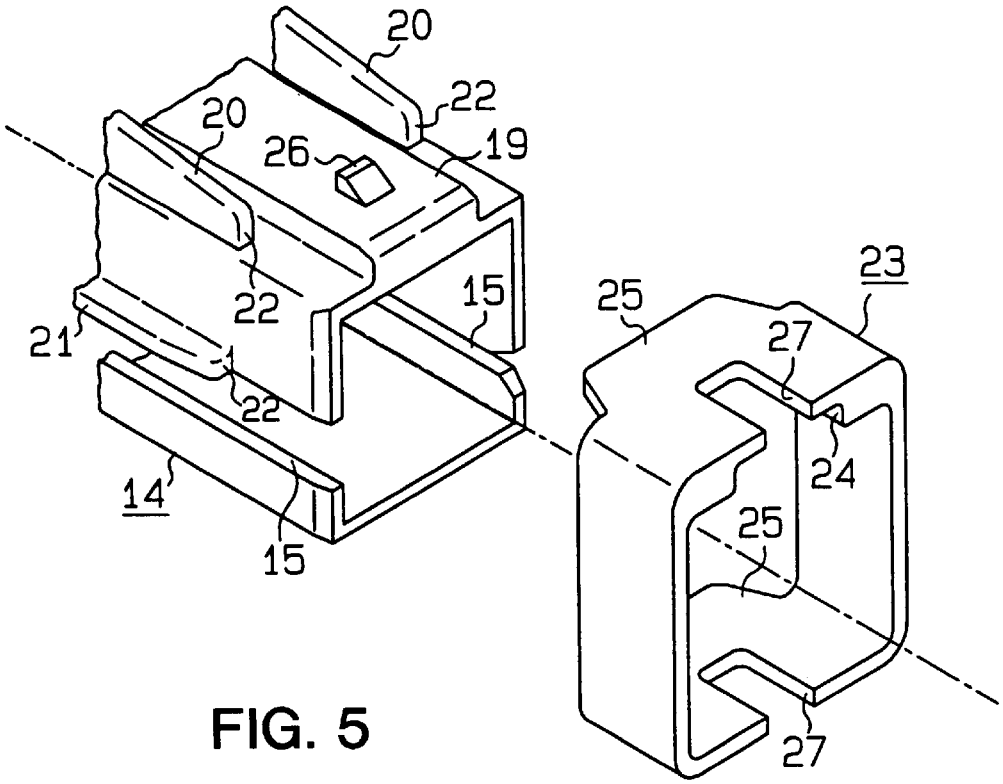
FIG. 5 is an exploded perspective view, similar to that of FIG. 4.
Figure 6:
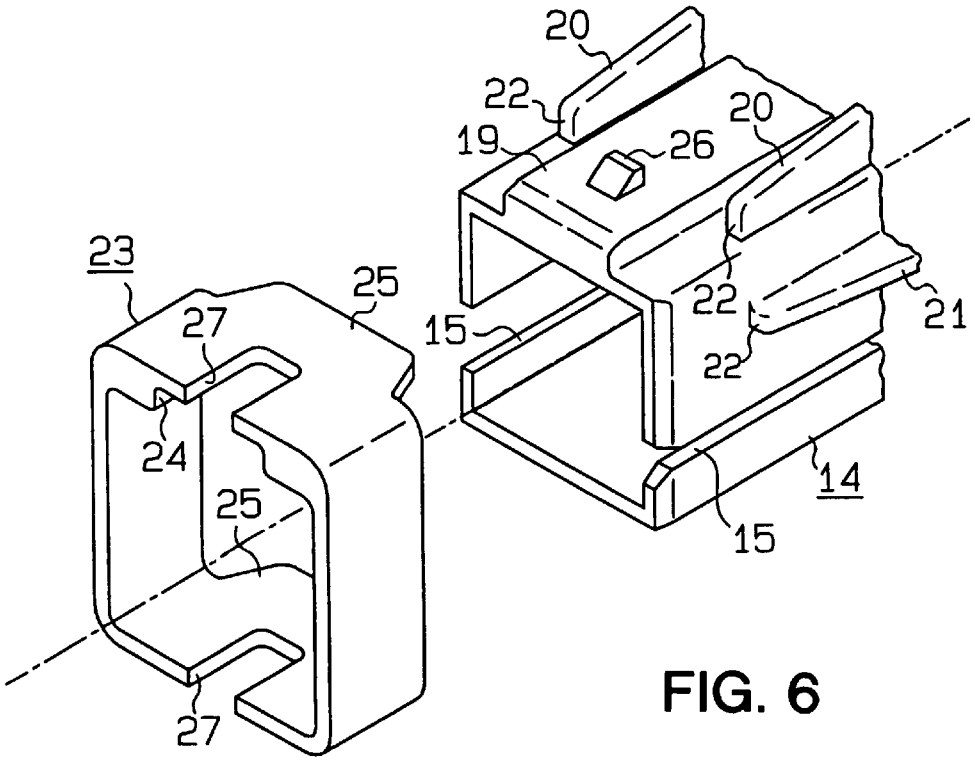
FIG. 6 is a perspective view, similar to that of FIG. 5, from a different angle.

Main housing 11, usually formed of an insulating material such as synthetic resin, is provided with insertion groove 13 at one end thereof and a plurality of mounting sections 12 on the other end. Connector holder 14, preferably having a cross section in the form of a four-sided cylinder, projects from main housing 11. Slits 15 are in the surrounding walls on either side and are contiguous with insertion groove 13.

Busbar 16, for electrical connections to other devices, is introduced into main housing 11 through slit 15 and insertion groove 13. A plurality of male terminals 17 are located at one end of busbar 16 so that they are within mounting sections 12. At the other end of busbar 16, contact terminal 18 is positioned within connector holder 14. When fusible links are mounted in mounting sections 12, they provide an electrical connection to busbar 16 via contact terminals 17.

Projection 19 extends along the upper surface of the outer perimeter of connection holder 14 and pairs of reinforcing ribs 20 are positioned on the upper and lower surfaces of connector holder 14. Reinforcing ribs 21 are formed on both side surfaces and positioning sections 22 are formed on the outer ends of the reinforcing ribs.

Retainer 23 fits over the outer perimeter of connector holder 14 and is preferably formed as a four-sided cylinder. Cavity 24, on the upper surface of the inner perimeter, engages projection 19. A pair of substantially trapezoidal insertion pieces 25 projects from the inner edge of retainer 23 and is adapted to be inserted between pairs of reinforcing ribs 20 which are located at the top and bottom of retainer 23. When the cavity, projection, reinforcing ribs, and insertion pieces are engaged, retainer 23 is in its attachment position. As a result, slit 15 is prevented from widening and the perimeter wall of connector holder 14 is supported in its prescribed shape.

Engagement claws 26 project from the upper and lower surfaces of the outer perimeter of connector holder 14. Complementary engagement claims 26 are formed on the outer edge of retainer 23 and correspond to engagement grooves 27. When retainer 23 is on the outer perimeter of connector holder 14, claws 26 and grooves 27 engage each other and maintain retainer 23 in the attachment position.

As particularly shown in FIGS. 1 to 6, connector unit 28 is releasably fitted in connector holder 14. Female connection terminal 29, which is adapted to mate with male contact terminal 18 of connector holder 14 is located in connector unit 28. Wire harness 30 is electrically connected to connection terminal 29 and extends from the base of connector unit 28.

Figure 7:
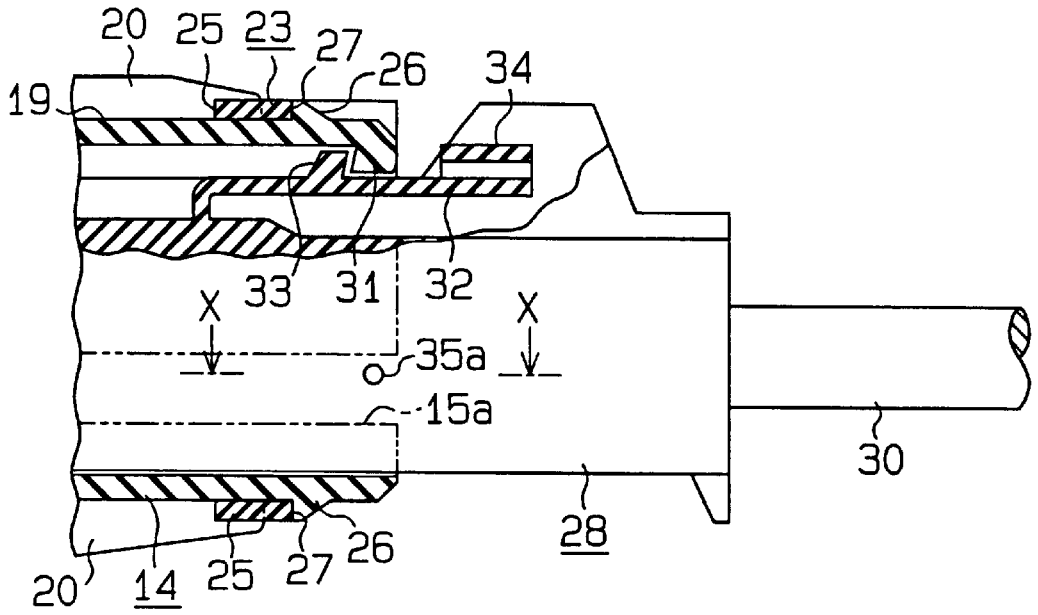
FIG. 7 is a view, similar to that of FIG. 3, of a preferred form of the present Invention.
Figure 9:
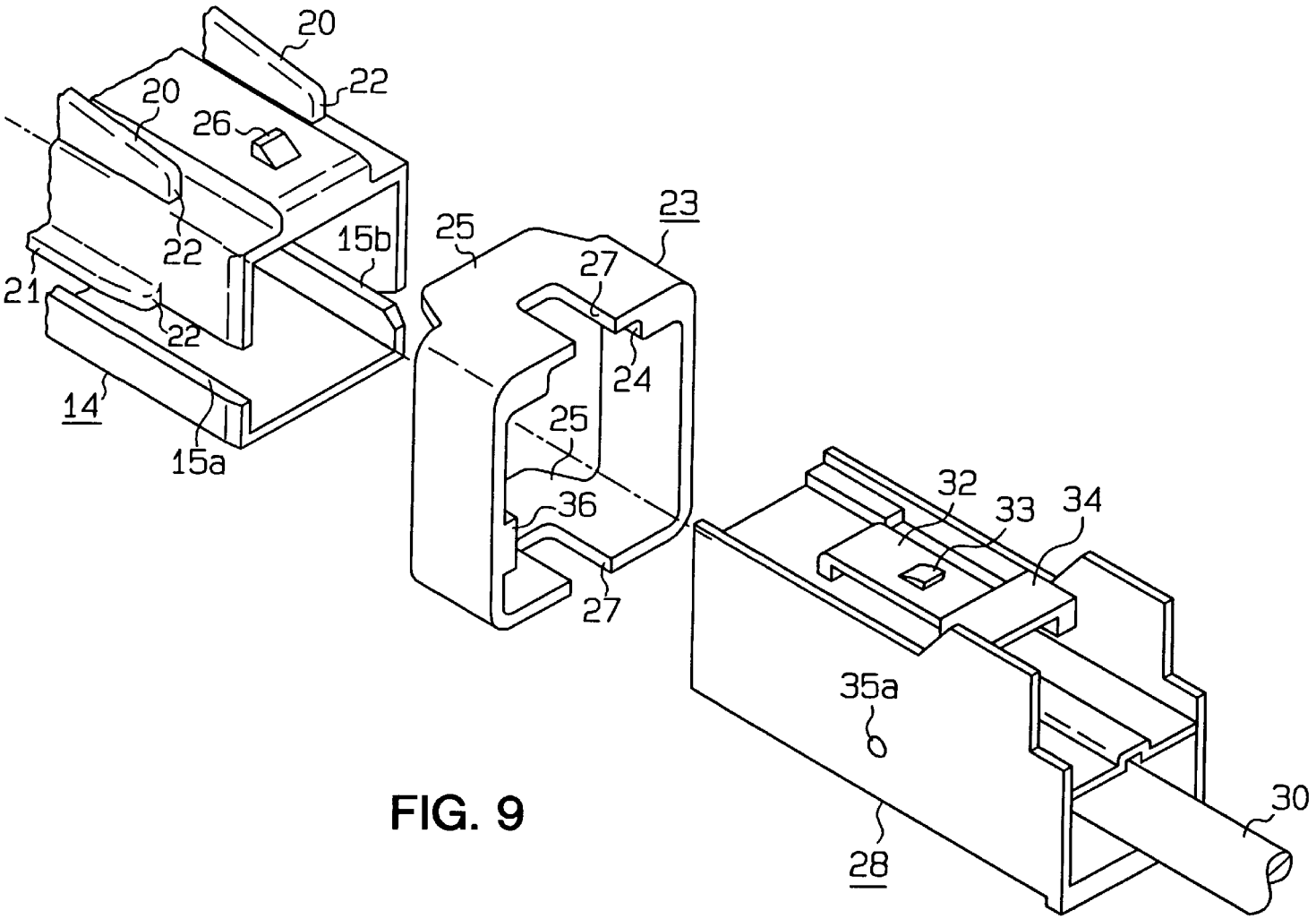
FIG. 9 is an exploded perspective view of the entire electrical connection box of the Invention.
Figure 10:
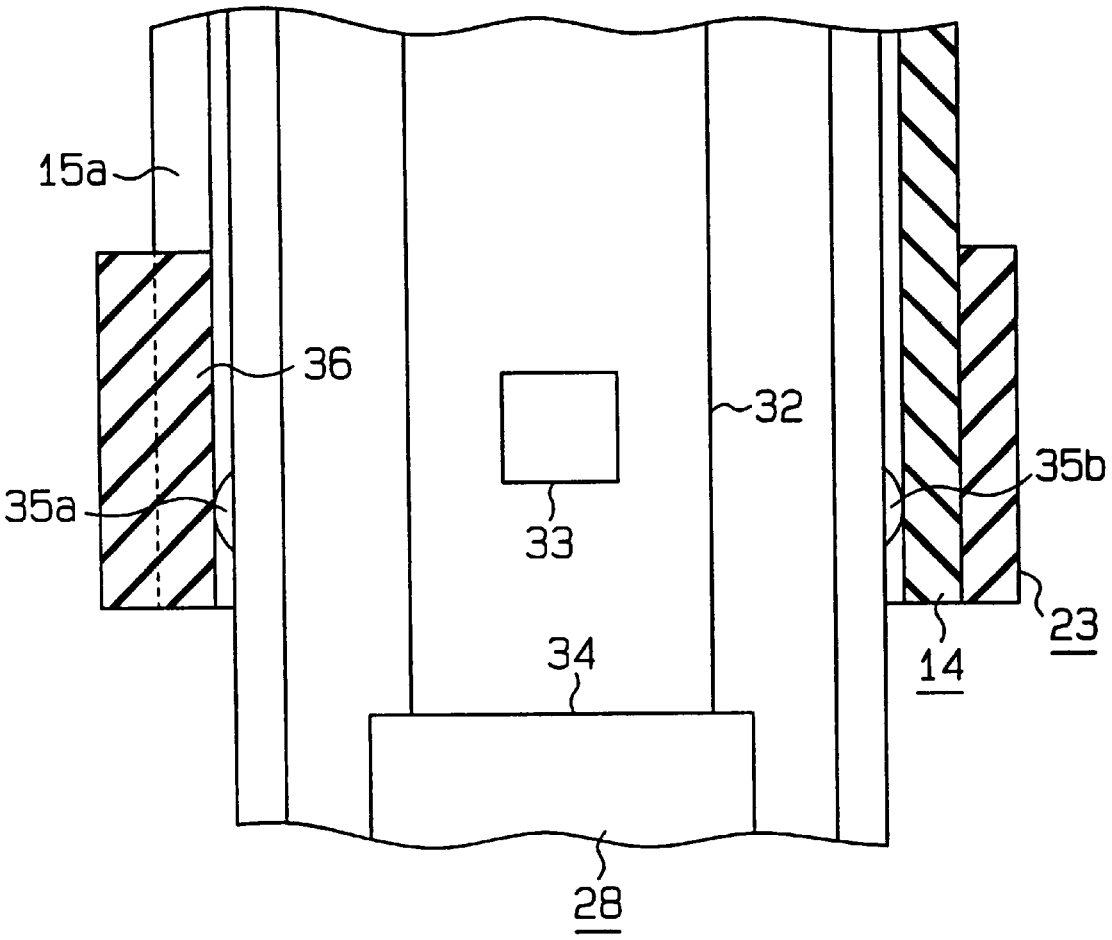
FIG. 10 is a cross section along line 10—10 of FIG. 7.
Figure 11:
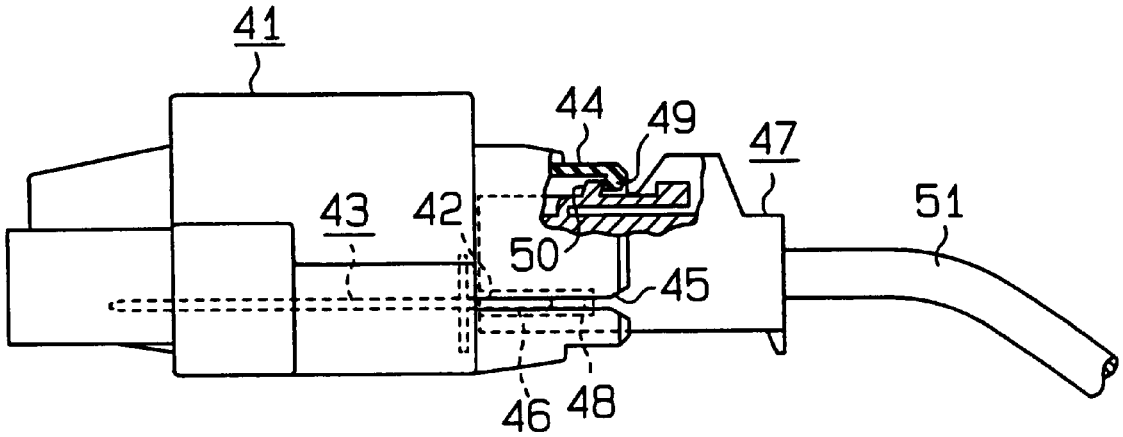
FIG. 11 PRIOR ART
FIG. 11 is a side view of a prior art connection box.

As shown in FIGS. 7, 9, and 10, engagement claw 31 projects from the outer edge of one end surface of the inner perimeter of connector holder 14. Elastic extension piece 32 is preferably integral with the front surface of the outer perimeter of connector unit 28. Elastic extension piece 32 carries release button 34 and engagement projection 33. Engagement claw 31 projects radially inwardly from the surface of projection 19. When connector unit 28 is fitted to connector holder 14, claw 31 and projection 33 engage each other and retain connector unit 28 in its fitted position. When release button 34 is pressed radially inwardly, projection 33 is disengaged from claw 31, thereby permitting the removal of connector unit 28 from holder 14.

The connection box of the present Invention is particularly designed for mounting in the engine compartment of a vehicle. Busbar 16 is electrically connected to a power supply (such as a battery) by means of wire harness 30. Connector unit 28 is inserted into connector holder 14 and wire harness 30 is thereby indirectly connected to the prescribed load elements. Busbar 16 distributes the current it receives from the power supply to the various electrical elements by way of the connection section between male contact terminal 18 and connector unit 28 through wire harness 30.

Figure 12:
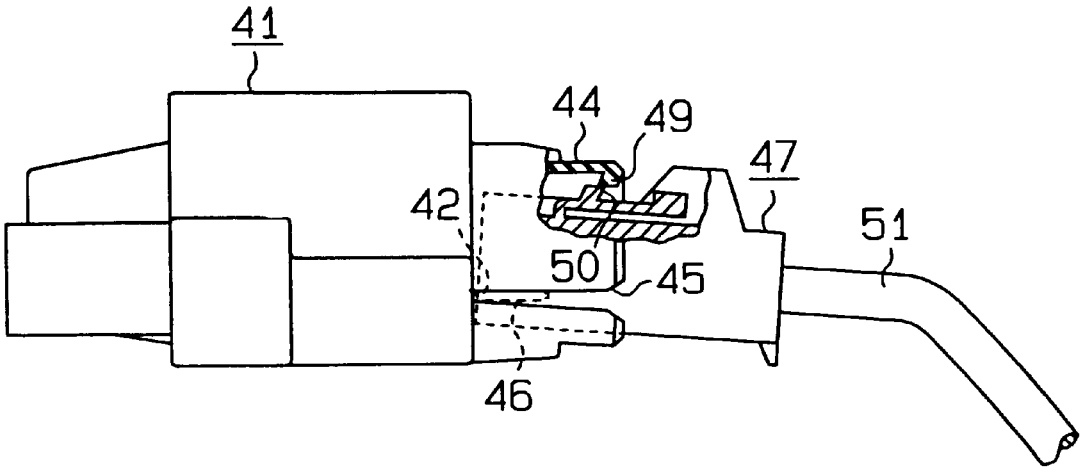
FIG. 12 PRIOR ART
FIG. 12 is a side view of the device of FIG. 11 showing the connector unit tilted.

Thus, it is a feature of the present Invention that, when connector unit 28 is fitted to connector holder 14, retainer 23, in its attachment position, exerts inward pressure on connector holder 14, thereby preventing the perimeter wall thereof from expanding at slit 15. This prevents connector unit 28 from assuming the tilted position as shown (with respect to prior art connector 47) in FIG. 12. Claw 31 and projection 33 provide reliable engagement for the fitting of connector unit 28 in connection holder 14.

Figure 8:
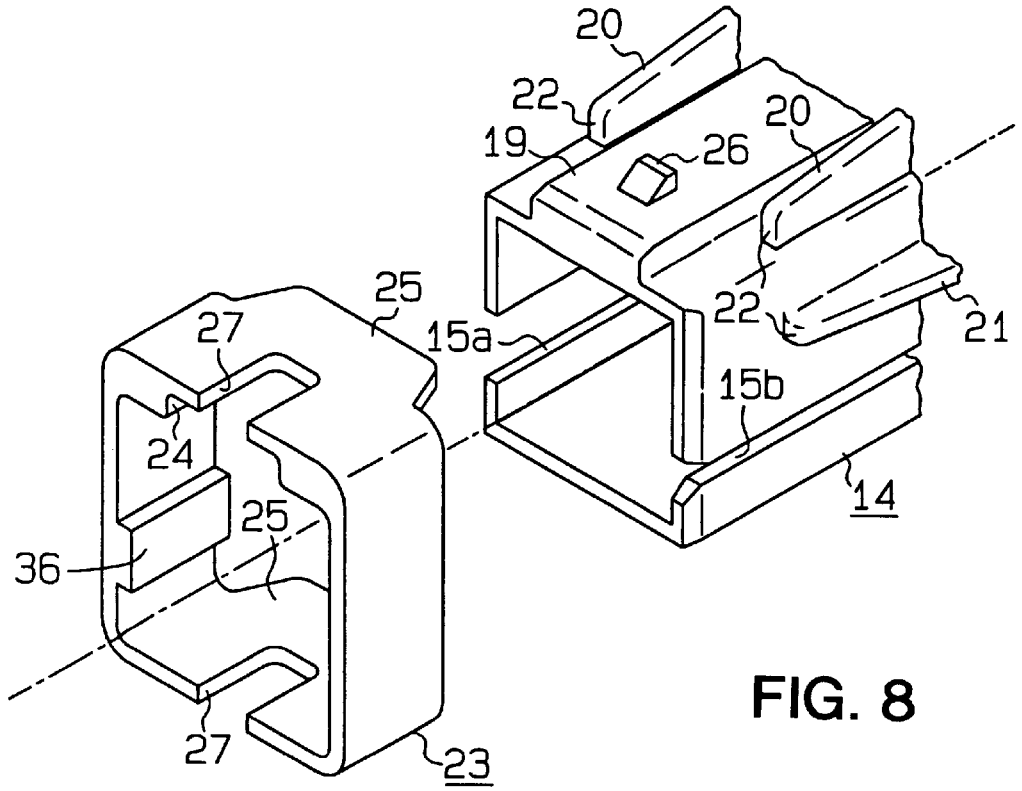
FIG. 8 is a view, similar to that of FIG. 6, of the Invention as shown in FIG. 7.

In a modification of the Invention, a pair of stabilizing projections 35*a* and 35*b* are located symmetrically on connector unit 28 (see particularly FIGS. 7, 9, and 10). Referring to FIGS. 5 to 9, slit 15*a* is wider than slit 15*b*, due to the structure of the mold dye. Contact section 36 (as shown in FIGS. 8, 9, and 10) projects inwardly from the inner perimeter wall of retainer 23 and slides in slit 15*a*. Preferably, it is molded integrally with retainer 23. The inner surface of contact section 33 is desirably coplanar with the inner perimeter wall surface of contact holder 14. Thus, as retainer 23 is brought into its attachment position on connector holder 14, contact section 36 is slidably guided along slit 15*a*.

When connector unit 28 is in its fitted position and connected to holder 14, stabilizing projection 15*b* contacts the inner perimeter wall surface of the holder. When retainer 23 is in its attachment position on holder 14, contact section 36 is inserted into slit 15*a*. Thus, stabilizing projection 35*a* contacts the inner surface of contact section 36 and stabilizing projections 35*a* and 35*b* are also in contact with elements of the box, whereby looseness in connector unit 28 is eliminated.

In a modification of the Invention, a pair of stabilizing projections 35*a* and 35*b* are located symmetrically on connector unit 28 (see particularly FIGS. 7, 9, and 10). Referring to FIGS. 5 to 9, slit 15*a* is wider than slit 15*b*, due to the structure of the mold dye. Contact section 36 (as shown in FIGS. 8, 9, and 10) projects inwardly from the inner perimeter wall of retainer 23 and slides in slit 15*a*. Preferably, it is molded integrally with retainer 23. The inner surface of contact section 33 is desirably coplanar with the inner perimeter wall surface of contact holder 14. Thus, as retainer 23 is brought into its attachment position on connector holder 14, contact section 36 is slidably guided along slit 15*a*.

When connector unit 28 is in its fitted position and connected to holder 14, stabilizing projection 15*b* contacts the inner perimeter wall surface of the holder. When retainer 23 is in its attachment position on holder 14, contact section 36 is inserted into slit 15*a*. Thus, stabilizing projection 35*a* contacts the inner surface of contact section 36 and stabilizing projections 35*a* and 35*b* are also in contact with elements of the box, whereby looseness in connector unit 28 is eliminated.

Thus, when connector unit 28 is fitted to connector holder 14, the alignment of stabilizing projection 35*a* with slit 15*a* will cause it to bear against contact section 36. In this manner, bad connections between female connection terminal 29 and male contact terminal 18 are reliably prevented. Moreover, since the inner surface of contact section 36 is substantially coplanar with the inner perimeter wall surface of connector holder 14, nothing projects from the inner surface of retainer 23 and connector unit 28 can be smoothly and easily inserted into connector holder 14.

It is preferable that contact section 36 be formed integrally with retainer 23. This reduces the number of steps required in producing the die used to mold the retainer and keeps production costs down. In placing retainer 23 on the outer perimeter of holder 14, contact section 36 slides along slit 15*a* and is guided thereby, thus making it easier to bring retainer 23 into its attachment position.

Although only a certain number of modifications of the present Invention have been expressly disclosed, such further or other modifications as would be apparent to the person of ordinary skill, may be made without departing from the scope or spirit thereof. For example, engagement claw 26 and engagement groove 27 can be interchanged so that the latter is formed on connector holder 14 and the former on retainer 23.

Instead of retainer 23 being formed as a cylinder or ring, it can be a flat plate attached by screws or the like to the outer surface of connector holder 14, thereby covering slit 15. It is also possible to provide positioning section 22 for retainer 23 independent of reinforcing ribs 21 and 22. This can be done, for example, by forming integral offsets on the outer surface of connector holder 14.

For additional tightness, contact section 36 can project slightly inward from the inner wall surface of connector holder 14. It is also possible that retainer 23 and contact section 36 are two separate elements which are held together by a suitable adhesive or the like.

Although only a specific number of modifications of the present Invention have been expressly disclosed, it is, nonetheless, to be broadly construed, and not to be limited except by the character of the claims appended hereto.

What I claim is:

1. An electrical connection box comprising a main housing, a hollow connector holder projecting from an outer face of said main housing, a retainer on an outer surface of said connector holder and complementary thereto, and a connector unit releasably connected to said connector holder, a busbar for forming electrical connections introduced into said main housing through an insertion groove on an exterior of said main housing, a slit, contiguous with said insertion groove, on a perimeter wall of said connector holder, a contact terminal projecting from said busbar into said connector holder, said connector unit releasably attached to an outer face of said connector holder, a connection terminal in said connector unit to connect to said contact terminal, said retainer surrounding said outer surface whereby a predetermined outer conformation of said perimeter wall is maintained.

2. The electrical connection box of claim 1 wherein said retainer is four-sided in cross section.

3. The electrical connection box of claim 1 wherein said retainer is circular in cross section.

4. The electrical connection box of claim 1 wherein one of said connector holder and said retainer is provided with one of an engagement projection or an engagement cavity, and another of said connector holder and said retainer is provided with another of said engagement projection and said engagement cavity, said engagement projection engaging said engagement cavity when said retainer is affixed to said connector holder.

5. The electrical connection box of claim 1 wherein there is a stabilizing projection on an external side surface of said connector unit, a contact section on an interior side wall of said retainer and in said slit, whereby said stabilizing projection is in contact with said contact section when said connector unit is affixed to said connector holder.

6. The electrical connection box of claim 5 wherein an inner surface of said contact section is coplanar with an inner wall of said connector holder.

7. The electrical connection box of claim 5 wherein said contact section is integral with said retainer and is adapted to slide along said slit as said retainer is placed on said connector holder.

* * * * *